US005913730A

United States Patent [19]

Johnson

[11] Patent Number: 5,913,730

[45] Date of Patent: Jun. 22, 1999

[54] GOLF PUTTER

[76] Inventor: Berthuld T. Johnson, 1551-97th Street, North Battleford, Saskatchewan, Canada, S9A 0K3

[21] Appl. No.: 08/235,931

[22] Filed: May 2, 1994

Related U.S. Application Data

[63] Continuation-in-part of application No. 08/107,632, Aug. 18, 1993, abandoned.

[51] Int. Cl.[6] ..... A63B 53/16; A63B 53/04

[52] U.S. Cl. ..... 473/204; 473/238; 473/251; 473/255

[58] Field of Search ..... 273/187.4, 186.2, 273/81.3, 193 B, 164.1, 80 C, 167 G, 81 C, 81 D, 187.6, 163 A, 163 R; 473/238, 242, 251, 255, 314, 219, 223, 231, 204

[56] References Cited

U.S. PATENT DOCUMENTS

| | | | |
|---|---|---|---|
| D. 183,180 | 7/1958 | Phillips | 273/164.1 |
| 837,030 | 11/1906 | Blanchard . | |
| 1,561,349 | 11/1925 | Murphy | 273/81.3 |
| 1,616,377 | 2/1927 | Knight | 273/81.3 |
| 1,690,388 | 11/1928 | Waldron | 273/169 |
| 3,033,574 | 5/1962 | Partridge | 273/187.4 |
| 3,170,690 | 2/1965 | Goranson | 273/193 B |
| 3,462,155 | 8/1969 | Pelz | 273/80 C |
| 3,663,019 | 5/1972 | Palotsee | 273/81.2 |
| 3,667,761 | 6/1972 | Palotsee | 273/164.1 |
| 3,888,484 | 6/1975 | Zitko | 273/164.1 |
| 4,141,556 | 2/1979 | Paulin | 273/164.1 |
| 4,605,228 | 8/1986 | Guendling | 273/80 C |
| 4,854,585 | 8/1989 | Koch | 273/186.2 |
| 4,953,867 | 9/1990 | Rigsby | 273/187.4 |
| 5,188,361 | 2/1993 | Coombe | 273/81.3 |

*Primary Examiner*—Sebastiano Passaniti
*Attorney, Agent, or Firm*—Adrian D. Battison; Murray E. Thrift

[57] ABSTRACT

A golf putter comprises a putter head which is generally triangular in plan view with a front face for engaging the ball and a flat base surface generally at right angles to the front face and extending rearwardly therefrom while tapering to a rear apex centrally of the putter face. An upper surface of the putter head includes a central ridge line extending downwardly from a top of the putter face to the rear apex of the base surface. The shaft is positioned centrally of the putter head and extends vertically upwardly therefrom at right angles to the base. The shaft is formed in two sections including a lower shaft section and an upper shaft section which can be moved relative to the lower shaft section from a conventional aligned position to a position at right angles thereto projecting at right angles to the front face of the putter head and rearwardly therefrom. In this position the upper shaft section, the central ridge and a pointer at the top of the putter face act as a directional guide for the putting action. The putter is then suspended vertically and swung in a pendulum action. In an alternative arrangement, a separate screw-in handle is provided on the side of the shaft at the upper end and a screw-in knob is provided on the end of the shaft for the pendulum action.

17 Claims, 2 Drawing Sheets

GOLF PUTTER

RELATED APPLICATIONS

This application is a continuation-in-part of application Ser. No. 08/107,632, filed 08/18/93, now abandoned.

BACKGROUND OF THE INVENTION

This invention relates to a golf putter.

Whenever I played golf, my fellow golfers and I often expressed that our lack of expertise in putting resulted in loss. I was advised to consider a pendulum swing stroke to improve my game. However, I found it difficult to acquire a true pendulum swing with a putter having a shaft mounted on an angle to one side.

After an exceptionally bad day on the green, I thought of a putter design that would lend itself to a pendulum stroke, a putter with balance and guides for alignment and design to minimize error when a ball is hit off centre. The description of my invention is by explanation of the drawings and in statement of my claims.

It is one object of the present invention, therefore, to provide an improved golf putter.

SUMMARY OF THE INVENTION

According to the invention, therefore, there is provided a golf putter comprising a putter head including a front putter face and a tail section extending rearwardly from the putter face having a substantially flat base at an angle slightly less than right angles to the putter face, the base tapering rearwardly from the front face toward a central apex spaced rearwardly of the front face and an upper surface of the head including a central ridge line extending from the apex toward the front face and two side faces each of which slopes downwardly from a respective side of the central ridge line to the base and a shaft secured to the upper surface of the head and extending upwardly therefrom in a direction substantially parallel to the front face and substantially at right angles to the base, the shaft comprising two shaft sections including an upper shaft section at a top end of the shaft and a lower shaft section extending from the upper shaft section to the head and means interconnecting the upper shaft section and the lower shaft section, said interconnecting means being arranged such that the upper shaft section can move from a first position in line with the lower shaft section to a second position at right angles to the lower shaft section and pointing in a direction at right angles to the front face and rearwardly therefrom.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

The putter of the present invention comprises a putter head 1 which is attached to a shaft extending upwardly therefrom, the shaft including a handle at the upper end by which the shaft can be grasped for movement of the putter head across the ground for striking a ball 10. The lower portion of the shaft is indicated at 2 in FIGS. 1 and 2 and an upper portion of the shaft which is of course of increased diameter due to the taper of the shaft is indicated at 2A in FIGS. 3 and 4.

Figure 2:
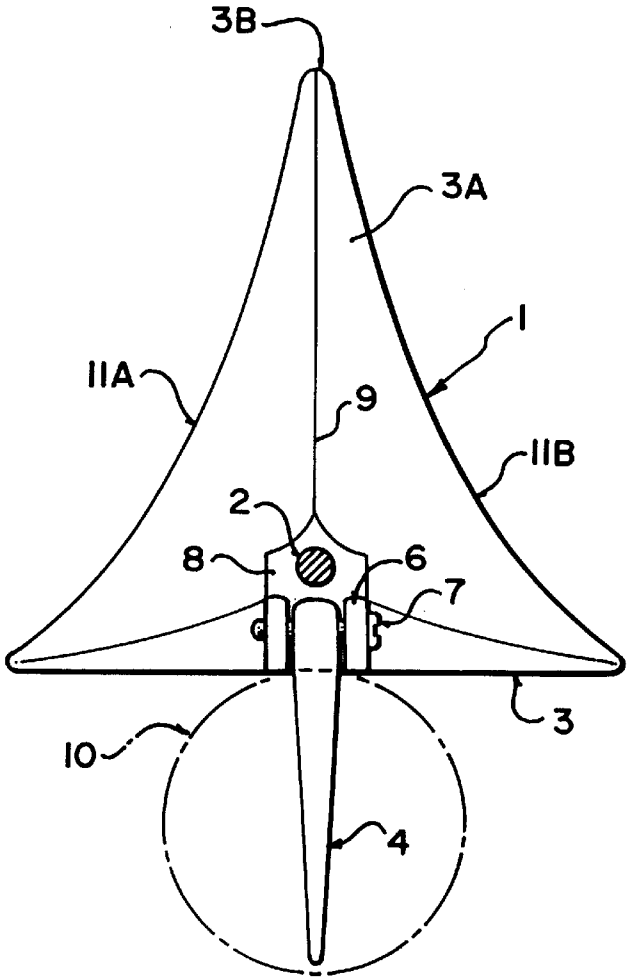
FIG. 2 is a cross-sectional view along the lines 2—2 of FIG. 1.

The putter head 1 includes a front putter face 3 which is substantially vertical in the putting position and thus is substantially parallel to the shaft 2. The putter face does however incline slightly rearwardly and upwardly in conventional manner. The putter face includes a horizontal lower edge forming a front edge of a base surface 11 of the head. The putter face from the lower edge tapers upwardly and inwardly to an upper surface 8 to which the shaft is attached. At the upper surface 8 is attached a directional pointer member 4 which is carried on a transverse pin or screw 7 between two fingers of a clevis 6. The pin 7 is horizontal and transverse to the direction of movement of the putter unless at right angles to the pointer member as shown in FIG. 2. The pointer member thus extends forwardly at right angles to the putter face and the position at the top of the putter face so as to extend out over the ball in the manner of a pointer to provide directional information to the golfer. The pointer member can however be pivoted about the pin 7 to a retracted position shown in dotted line at 5 in which it lies vertically upwardly substantially alongside and parallel to the shaft 2.

The clevis 6 and the screw 7 are of course relatively tight on the pointer so that the pointer is maintained by frictional contact in either the pointing position or the retracted position as required.

The position of engagement of the shaft 2 with the upper surface 8 of the head is arranged to be at the point of equilibrium between the putter face 3 and a tail section 3A of the head. The tail section is generally triangular in plan view as shown in FIG. 2 with side edges 11 which taper inwardly and rearwardly from the bottom edge of the front face 3 to a rear apex 3B. The putter head thus comprises the flat base 11 together with the side edges 11A and 11B and the front bottom edge of the front face 3. The base is thus substantially flat and substantially at right angles to the front face 3 but inclined slightly upwardly and rearwardly. This allows the apex 3B to clear the ground as the head swings in a pendulum arc. The side edges 11A and 11B are slightly concave so that the surfaces which taper downwardly from the central ridge 9 to the edges 11A and 11B are similarly slightly concave. The surfaces between the top edge of the front face, the central ridge 9 and the edge 11A are thus also triangular. The ridge 9 lies central of the head at right angles to the front face 3 and aligned with the pointer 4 so as to act as a directional guide.

Figure 3:
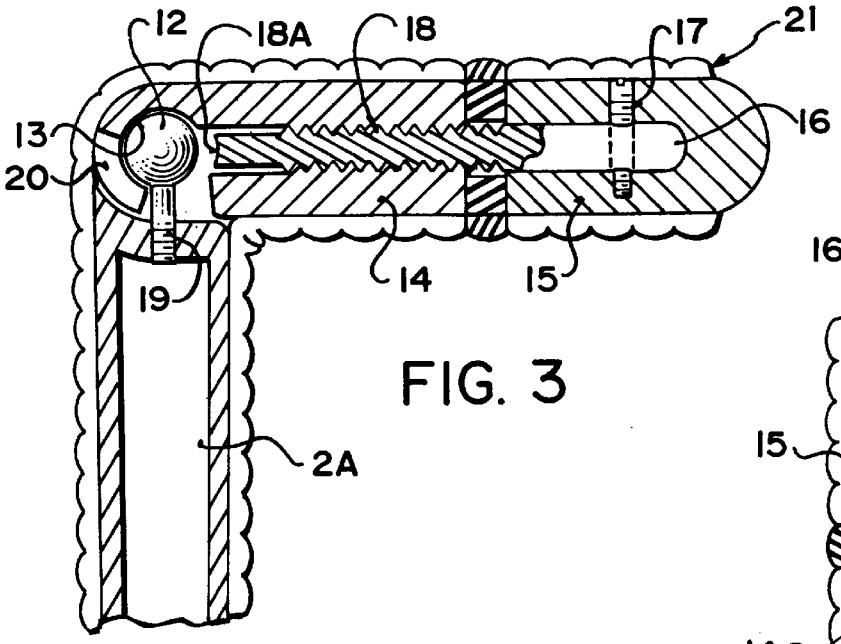
FIG. 3 is a vertical cross-sectional view through the putter of FIG. 1 showing the upper end of the shaft only.
Figure 4:
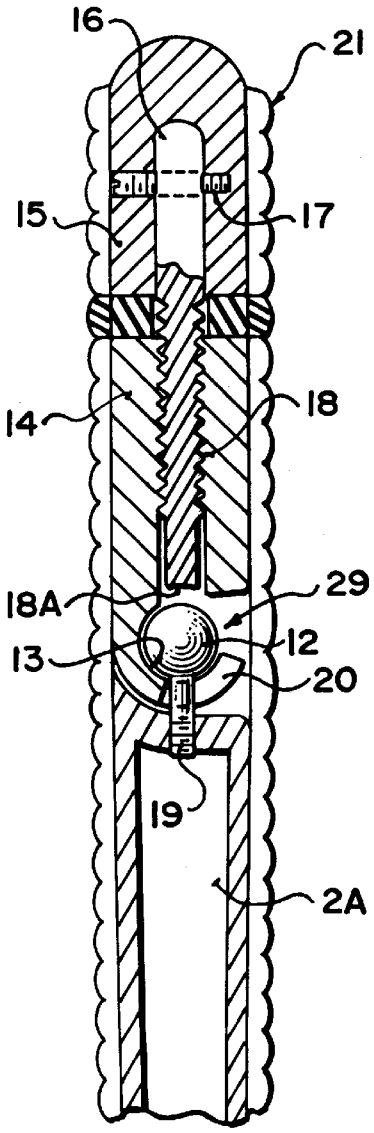
FIG. 4 is a similar vertical cross-sectional view of that of FIG. 3 showing an upper shaft section in a vertical or aligned position.

Turning now to FIGS. 3 and 4, the shaft is straight so as to extend directly vertically upwardly from the putter head and is divided into an upper shaft section 14, 15 and a lower shaft section 2A. The upper shaft section is connected to the lower shaft section by interconnecting means generally indicated at 30. The interconnecting means in the embodiment shown comprises a ball 12 with a stem 19 connected to the shaft section 2A. The interconnecting means further includes a socket 13 which receives the ball 12 to allow pivotal movement of the upper shaft section relative to the lower shaft section about the ball. The socket 13 includes a slot 20 which allows the stem 19 to slide between the two fingers of the slot to direct the pivotal movement of the upper shaft section between the first position shown in FIG. 3 and the second position shown in FIG. 4. The upper shaft section can be locked in the first and second positions by a locking system comprising basically a threaded rod 18 moveable axially within the upper shaft section. The threaded rod includes a clamping end 18A for engaging the ball and locking the upper shaft section in position relative to the ball 12. The shaft 18 is moved axially by rotation within the upper shaft section and cooperation between an outer thread on the shaft and a female thread within the upper shaft section. The upper shaft section thus forms two parts 14 and 15 respectively, the inner part 14 being fixed relative to the lower shaft section against rotation about the axis of the rod 18 while the outer portion 15 can rotate and thus drives rotation of the rod or screw 18. The rod or screw 18 includes an end portion attached to the portion 15 of the upper handle section by a pin 17.

The upper end of the shaft is covered by a rubber or similar composite material covering defining a handle 21. This covering material is of a generally conventional nature generally provided as a hand grip on a conventional club but is arranged to cover both the upper shaft section and a part only of the lower shaft section terminating before the lowermost part 2 of the shaft. The handgrip comprises a substantially continuous sleeve 21 extending from the upper end of the upper shaft portion along the upper shaft portion and part of the lower shaft portion. The flexibility of the handgrip allows it to accommodate the movement at the joint.

Figure 1:
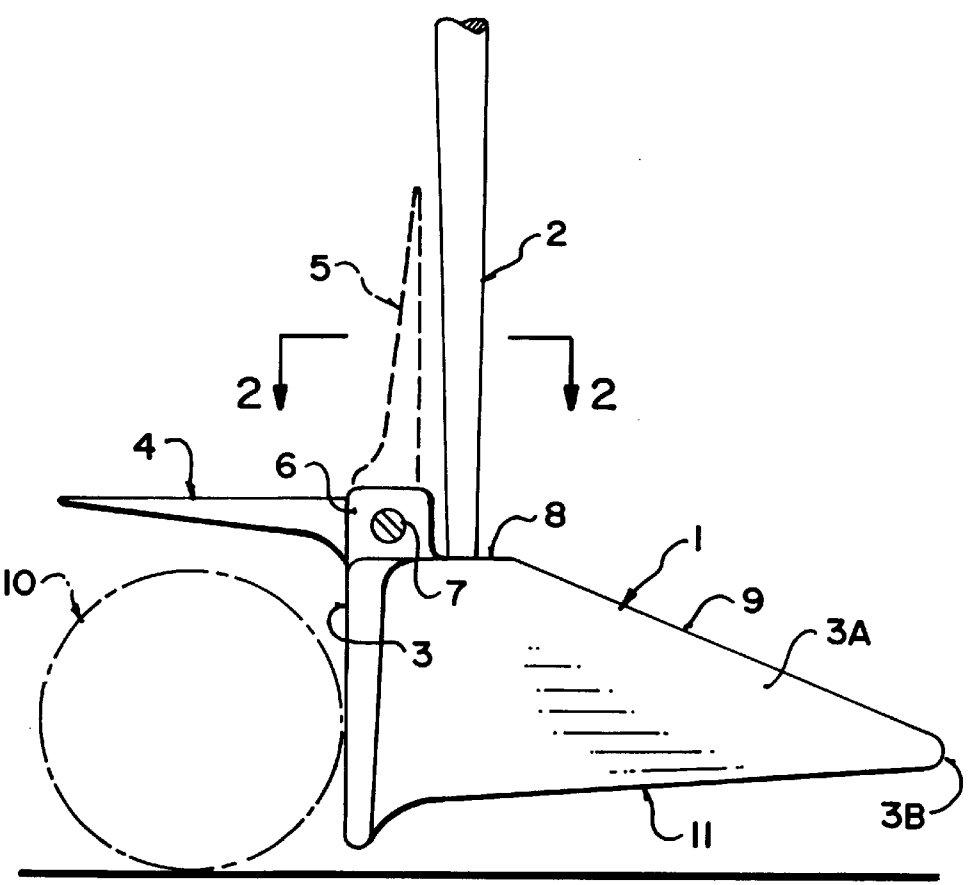
FIG. 1 is a side elevational view of the putter head and a portion only of the shaft of a putter according to the present invention.

As shown in FIGS. 1 and 2, the shaft 2 is anchored in a point on the upper surface 8 which is the point of equilibrium between the front section of the putter head defined by the front face 3 and the tail section of the putter head defined by the tail 3A, that is symmetrical of the center line of the head. The shaft is parallel to the front face 3 and at right angles to the base 11. The base 11 is flat and is on a plane a few degrees less than right angles to the face 3. This avoids the tail from contacting the green when following through in the pendulum arc action of the putter.

The pointer member 4 and the central ridge 9 thus act as a guide for the line of drive of the putter.

The combination of the putter head and the shaft as described above allows for a true pendulum swing stroke in that the player positions the putter to hang vertically downwardly. In play, a rule of thumb which of course varies depending upon conditions and the slope of the green, allows a swing stroke of 1 inch for every foot of desired ball travel.

The handle arrangement including the upper shaft section and the lower shaft section allows the shaft to be used in conventional manner as shown in FIG. 4 in which the upper shaft section is directly aligned axially with the lower shaft section. However when the upper shaft section is moved to the position shown in FIG. 3, it is arranged to project a right angle to the lower shaft section and generally at right angles to the front face 3 away from the direction of drive of the ball. In this position the upper shaft section also acts as a guide for the line of drive. Furthermore the grasping of the upper shaft section in this position acts to hold the putter at right angles to the intended line of drive and to prevent twisting of the putter face should the ball be struck to one side of the putter face. The upper handle section, pointing away from the face of the putter provides a handle for the golfer's upper hand and acts as a guide for the pendulum swing direction while the lower hand of the golfer grasps the lower shaft section at the handle portion 2A thereof.

In an alternative arrangement (not shown) the interconnecting means between the upper shaft section and the lower shaft section can be provided by a simple hinge arrangement or knee joint defined by a transverse horizontal pin lying at right angles to the shaft and parallel to the front face 3. On the pin is provided clevis arrangement on one shaft portion and intervening web on the other shaft portion which allow the pivotal movement and when clamped provide sufficient frictional resistance to hold the upper shaft section in the required first and second positions.

Figure 5:
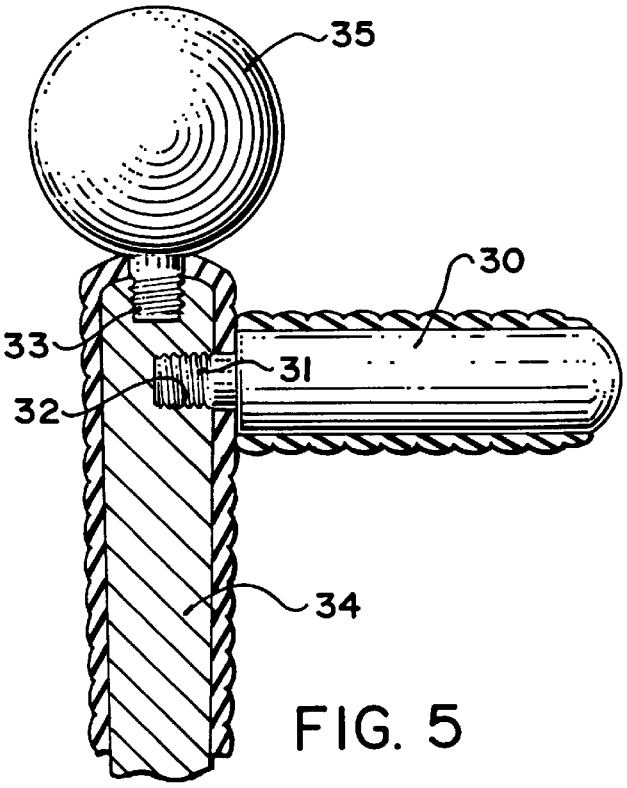
FIG. 5 is a cross-sectional view similar to that of FIG. 3 showing an alternative arrangement of the handle of the shaft.

As a yet further alternative shown in FIG. 5, the upper shaft section or handle can be formed as a separate element 30 with a male screw thread portion 31 projecting from its lower end for engagement into a female threaded receptacle 32 in the upper end 33 of the lower or main shaft section 34. The handle is thus fixed in place at a fixed angle that is at right angles to the main shaft portion or the handle can be unscrewed and removed. In addition a spherical ball shaped knob 35 is attached to the top of the shaft again by a screw-in fastening allowing the knob to be removed if required. The club can thus be used with the handle and knob in the pendulum action described above or the handle and knob can be removed and the club used as a conventional club.

Since various modifications can be made in my invention as herein above described, and many apparently widely different embodiments of same made within the spirit and scope of the claims without departing from such spirit end scope, it is intended that all matter contained in the accompanying specification shall be interpreted as illustrative only and not in a limiting sense.

I claim:

1. A golf putter comprising a putter head including a front putter face and a body rearwardly of the putter face, the body having a top surface and a base, and a shaft secured to the top surface of the head and extending upwardly therefrom in a direction substantially parallel to the front face and substantially symmetrically of a center line of the head extending at right angles to the front face and substantially at right angles to the base, the shaft comprising two shaft sections including an upper shaft section at a top end of the shaft and a lower shaft section extending from the upper shaft section to the head and means interconnecting the upper shaft section and the lower shaft section, said interconnecting means being arranged such that the upper shaft section can move from a first position in line with the lower shaft section to a second position at right angles to the lower shaft section and pointing in a direction at right angles to the front face and rearwardly therefrom, and wherein the interconnecting means is arranged to provide pivotal movement from the first position to the second position, and wherein the interconnecting means includes means to lock the shaft sections in each of said first and second positions.

2. The putter according to claim 1 wherein the head is shaped such that the base is substantially flat and is arranged at an angle slightly less than right angles to the putter face, with the base tapering rearwardly from the front face toward a central apex spaced rearwardly of the front face and such that the top surface of the head includes a central ridge line extending from the apex toward the front face and such that the head includes two side faces each of which slopes downwardly from a respective side of the central ridge line to the base.

3. The putter according to claim 1 wherein the interconnecting means comprises a ball and socket assembly.

4. The putter according to claim 1 wherein the upper shaft section includes a screw portion rotatable about a longitudinal axis of the upper shaft section and having a thread thereon cooperating with a corresponding thread of the upper shaft section, the screw portion being thus movable axially to engage and clamp said interconnecting means.

5. The putter according to claim 1 including handgrip means provided on the shaft at the upper end thereof, the handgrip means being arranged to cover all of the upper shaft section and a part of the lower shaft section.

6. The putter according to claim 5 wherein the handgrip means comprises a substantially continuous sleeve and wherein the sleeve is sufficiently flexible to accommodate said movement.

7. The putter according to claim 2 wherein the base is substantially triangular and the central apex is substantially pointed.

8. The putter according to claim 1 including a pointer member mounted on the head at the top surface and arranged to extend horizontally substantially at right angles to the face, centrally of the face and forwardly of the face.

9. The putter according to claim 8 wherein the head is shaped such that the base is substantially flat and is arranged at an angle slightly less than right angles to the putter face, with the base tapering rearwardly from the front face toward a central apex spaced rearwardly of the front face and such that the top surface of the head includes a central ridge line extending from the apex toward the front face and such that the head includes two side faces each of which slopes downwardly from a respective side of the central ridge line to the base wherein the pointer is substantially aligned with the central ridge.

10. The putter according to claim 8 wherein the pointer is mounted on the head for pivotal movement relative thereto from the horizontal position to a raised retracted position substantially alongside the shaft.

11. A golf putter comprising a putter head including a front putter face and a body rearwardly of the putter face, the body having a top surface and a base, and a shaft secured to the top surface of the head and extending upwardly therefrom in a direction substantially parallel to the front face and substantially symmetrically of a center line of the head extending at right angles to the front face and substantially at right angles to the base, the shaft comprising a main shaft section and a handle section arranged at an upper end of the main shaft section at right angles to the main shaft section and pointing in a direction at right angles to the front face and rearwardly therefrom, and wherein the handle section is arranged at a fixed angle relative to the main shaft section.

12. The putter according to claim 11 wherein the handle section is removable from the main shaft section.

13. The putter according to claim 11 including a pointer member mounted on the head at the top surface and arranged to extend horizontally substantially wait right angles to the face, centrally of the face and forwardly of the face.

14. The putter according to claim 13 wherein the head is shaped such that the base is substantially flat and is arranged at an angle slightly less than right angles to the putter face, with the base tapering rearwardly from the front face toward a central apex spaced rearwardly of the front face and such that the top surface of the head includes a central ridge line extending from the apex toward the front face and such that the head includes two side faces each of which slopes downwardly from a respective side of the central ridge line to the base wherein the pointer is substantially aligned with the central ridge.

15. The putter according to claim 13 wherein the pointer is mounted on the head for pivotal movement relative thereto from the horizontal position to a raised retracted position substantially alongside the shaft.

16. A golf putter comprising a putter head including a front putter face and a body rearwardly of the putter face, the body having a top surface and a base, a shaft secured to the top surface of the head and extending upwardly therefrom in a direction substantially parallel to the front face and substantially symmetrically of a center line of the head extending at right angles to the front face and substantially at right angles to the base, and a pointer member mounted on the head at the top surface and arranged to extend horizontally substantially at right angles to the face, centrally of the face and forwardly of the face, and wherein the head is shaped such that the base is substantially flat and is arranged at an angle slightly less than right angles to the putter face, with the base tapering rearwardly from the front face toward a central apex spaced rearwardly of the front face and such that the top surface of the head includes a central ridge line extending from the apex toward the front face and such that the head includes two side faces each of which slopes downwardly from a respective side of the central ridge line to the base wherein the pointer is substantially aligned with the central ridge.

17. The putter according to claim 16 wherein the pointer is mounted on the head for pivotal movement relative thereto from the horizontal position to a raised retracted position substantially alongside the shaft.

* * * * *